United States Patent [19]

Hassell

[11] 4,176,476

[45] Dec. 4, 1979

[54] CUSHION INSOLE

[75] Inventor: Aarno A. Hassell, Storrs, Conn.

[73] Assignee: Rogers Corporation, Rogers, Conn.

[21] Appl. No.: 896,169

[22] Filed: Apr. 14, 1978

[51] Int. Cl.[2] ..... A43B 13/40

[52] U.S. Cl. ..... 36/44; 36/14; 428/315

[58] Field of Search ..... 36/44, 43, 14; 428/315, 428/311, 310

[56] References Cited

U.S. PATENT DOCUMENTS

| | | | |
|---|---|---|---|
| 3,147,558 | 9/1964 | Bingham, Jr. | 36/14 |
| 3,448,533 | 6/1969 | Beckwith | 36/44 |
| 3,752,695 | 8/1973 | Finelli | 428/310 |
| 3,835,208 | 9/1974 | Koutitonsky | 428/315 X |
| 3,873,407 | 3/1975 | Kumata | 428/315 X |
| 4,017,656 | 4/1977 | Lasman et al. | 428/311 X |

FOREIGN PATENT DOCUMENTS

| | | | |
|---|---|---|---|
| 1417324 | 10/1965 | France | 36/14 |

*Primary Examiner*—James Kee Chi

[57] ABSTRACT

A cushion insole for shoes comprising a unitary combination material that includes a skin of wear material which is integral with a layer of resilient foam material, the foam material being wrapped around and adhered to a boardlike support which is relatively rigid and stiff. The insole may be adhered to a sole.

5 Claims, 3 Drawing Figures

CUSHION INSOLE

BACKGROUND OF THE INVENTION (1) Field of the Invention

This invention relates to cushion insoles for shoes and a sole-insole unit for shoes.

(2) Description of the Prior Art

It is known to construct a cushion insole by using three different materials. Referring to FIG. 1, which shows a prior art cushion insole, support board 20, which is relatively rigid and stiff and made out of a fibrous material, has adhered to it a layer of cushioning material 21 such as sponge or foam. A wear material 22 such as leather, synthetic leather or a leather-like coated fabric is wrapped around the support material and the cushioning material and provides a wear surface. The wear material is adhered to the cushioning material and the support board with a conventional adhesive. The insole, which includes the support board, the cushioning material and the wear material may then be inserted into and adhered to sole 23 for use in a shoe.

There are many disadvantages with the above-described construction. The finished insole when flexed repeatedly forms excessive wrinkles over the surface thereof which tend to make the insole less comfortable for the shoe wearer and which create an unattractive appearance. As the shoe wearer uses the insoles of the prior art, the wear surface may tend to separate from the cushioning material thus creating further wrinkling and slippage between the wear material and the cushioning material thereby further discomforting the shoe wearer. The prior art construction has a further disadvantage in that the construction comprises three different materials which must be adhered together to manufacture the insole. It should be understood that the production of such insoles is relatively expensive because three materials must be purchased and handled.

It is an object of the present invention to provide an insole which reduces excessive wrinkling when flexed repeatedly and which provides for a pleasing appearance. Another object of the invention is to reduce slippage between the wear material and the cushioning material. Another object of the present invention is to reduce the number of materials required to fabricate the insole thereby reducing material and handling costs.

SUMMARY OF THE PRESENT INVENTION

The present invention provides a cushion insole for shoes wherein a support material is covered and has adhered to it a unitary combination material which includes a skin of wear material which is integral with a layer of resilient foam material.

With a construction of the present invention, excessive wrinkling is reduced and an asthetically pleasing insole is provided. Also, with the use of a unitary combination material, slippage between the wear material and the foam material is reduced. The construction of the insole allows for the insole to be made of two materials rather than three materials and, thus, the cost of purchasing the materials and the fabrication cost are reduced.

DETAILED DESCRIPTION OF THE INVENTION

Figure 1:
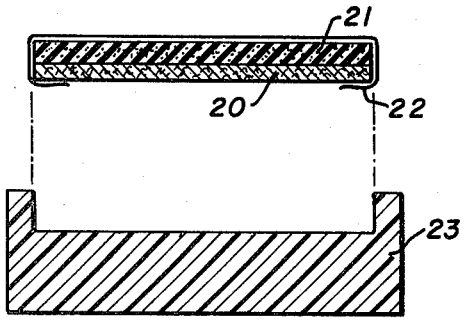
FIG. 1 shows a sole-insole unit of the prior art.

Sole-insole unit 1 comprises insole 2 and sole 3. Insole 2 includes a relatively rigid and stiff support material 4 having upper surface 5 and lower surface 6 and edge 7. Adhered to upper surface 5, edges 7 and a portion of lower surface 6 of support material 4 is unitary combination material 8 that includes skin 9 of wear material which is integral with layer 10 of resilient foam material 10.

Unitary combination material 8 is wrapped around and covers surface 5 and edge 7 of support material 4. Unitary combination material 8 covers only a portion of lower surface 6 of support material 4 and, because combination material 8 has a relatively large thickness, projection 11 which depends from insole 2 is provided.

Sole 3 includes outer wall 12 which extends around the circumference of sole 3 and which extends vertically from sole bottom 13. The interior portion 14 of sole 3 includes support surface 15 including detent 16 which extends inwardly from wall 12. Detent 16 is shaped to provide for the close fitting of protrusion 11 of insole 2.

Figure 2:
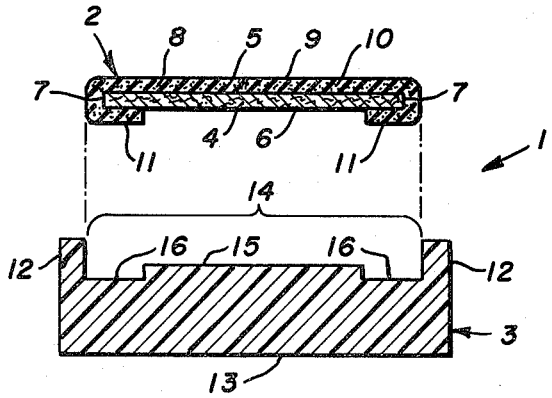
FIG. 2 shows a cross section of the sole-insole unit of the present invention.

FIG. 2 shows insole 2 separated from sole 3. When a sole-insole unit is fabricated, insole 2 is adhered to support surface 15 of sole 3 and protrusion 11 is interfitted with and adhered to detent 16. Although FIG. 2 shows unitary combination material 8 adhered to only a portion of lower surface area 6 of support material 4, it should be understood that unitary combination material 8 can extend across the entire lower surface 6 of support material 4. The interior surface 15 of sole 3 can be flat and extend to wall 12 in order to accommodate the insole. Support material 4 should be relatively rigid and firm and can be made of any conventional material such as fiber board or leatherboard.

Unitary combination material 8 should include a skin 9 of wear material which is integral with a layer of foam material 10. What is meant by the skin being integral with the foam is that the skin be made of a material having the same or similar chemical composition as the foam but having a different physical structure. It is preferred that the foam portion of unitary combination material 8 have a relatively low density, and include open and/or closed pores to provide a combination material that is capable of cushioning the foot of a person wearing a shoe which includes the insole of the present invention. It is preferred that skin 9 be tear resistant and have a relatively high density. In such unitary combination materials, there is often not a clear physical structure differentiation between the skin and the foam material, the portions of the unitary combination material being more like skin towards the surface of the material, and more like foam toward the interior of the material. Particularly preferred chemical compositions for use in the unitary combination material of the present invention are disclosed in U.S. Pat. No. 3,772,224, which discloses a process for the production of polyurethane foam from a heat curable froth. Another patent which discloses a material which may be used in the present invention is U.S. Pat. No. 3,816,233, which discloses a method for the manufacture of urethane foam sheets to provide a sheet wherein one side of the sheet is a high density porous structure and the body of the sheet is a low density urethane foam. A particularly preferred material for use in the present invention is disclosed in U.S. Patent Application Ser. No. 619,389, filed Oct. 3, 1975 by Jeffrey B. Otto, said patent application being assigned to the assignee of the present application.

As stated earlier, unitary combination material 8 is adhered to support material 4. This may be done in any conventional manner, such as, for example, the use of conventional adhesives used in shoe manufacture such as natural rubber latex cement, synthetic latex cement and solvent based cements. Insole 3 can be adhered to sole 2 in any conventional manner, such as, for example, by the adhesives mentioned immediately above.

Figure 3:
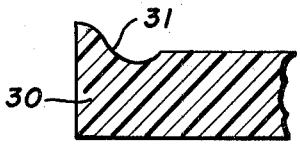
FIG. 3 shows an alternative of a sole to which the insole of FIG. 2 may be adhered.

FIG. 3 shows an alternative embodiment of a sole to which insole 2 of FIG. 2 may be adhered. Sole 30 includes rounded detent 31 to provide for interfitting of protrusion 11 of insole 2.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A cushion insole for shoes consisting essentially of:

means for support which is relatively rigid and stiff; and a unitary combination sheet material comprising a skin of wear material integral with a layer of resilient foam material, said foam material being adhered to said means for support.

2. A cushion insole according to claim 1 wherein said support means comprises a board having an upper and a lower surface and an edge, said foam material is adhered to said upper surface and said edge.

3. A cushion insole according to claim 2 wherein said combination material extends continuously across said upper surface around said edges and across a portion of said lower surface to provide a projection.

4. A sole-insole combination for a shoe comprising:

(a) a sole having an upper surface including a detent; and (b) a cushion insole as described in claim 3, said protrusion interfitting with said detent and said sole adhered to said insole.

5. A sole-insole combination for a shoe comprising:

a sole having an upper surface and a lower surface and a peripheral wall, said upper surface of said sole including a detent spaced inwardly from said peripheral wall of the sole; and a cushion insole including a support board which is relatively rigid and stiff and a unitary combination sheet material comprising a skin of wear material integral with a resilient foam material, said support board including an upper and a lower surface and an edge, said combination material extending continuously across said upper surface around said edge and across a portion of said lower surface to provide a projection, said projection interfitting with said detent.

* * * * *